United States Patent [19]

Ives et al.

[11] 3,957,600

[45] May 18, 1976

[54] METHOD OF AND ANODES FOR USE IN ELECTROWINNING METALS

[75] Inventors: Andrew George Ives, Kidderminster; John Roger Bawden Gilbert, Sutton Coldfield; Jan Stephan Jacobi, Wolverhampton; Ian Robert Scholes, Sutton Coldfield; David John Astley, Selly Oak, all of England

[73] Assignees: IMI Refinery Holdings Limited, Stafforshire; Imperial Metal Industries (Kynoch) Limited, Birmingham, both of England

[22] Filed: Dec. 20, 1974

[21] Appl. No.: 534,867

[30] Foreign Application Priority Data

Dec. 27, 1973 United Kingdom..... 59795/73

[52] U.S. Cl...... 204/105 R; 204/293

[51] Int. Cl.[2]..... C25C 1/00; C25B 11/10

[58] Field of Search..... 204/293, 105 R; 75/126 D, 126 F, 128 G, 128 Z, 128 T

[56] References Cited

UNITED STATES PATENTS 2,117,284 5/1938 Bieber et al. ..... 204/293

*Primary Examiner*—R. L. Andrews

*Attorney, Agent, or Firm*—Cushman, Darby & Cushman

[57] ABSTRACT

Anodes of alloys, which may be fragmented and used in baskets, of passive film-forming metals and elements having atomic numbers 23–29 for use in electrowinning metals, methods of using such anodes, and electrowinning cells incorporating such anodes.

18 Claims, 5 Drawing Figures

METHOD OF AND ANODES FOR USE IN ELECTROWINNING METALS

BACKGROUND OF THE INVENTION

This invention relates to a method of electrowinning metals and to cells and anodes for use in connection with such a method.

The extraction and recovery of metals from aqueous acidic solutions by electrowinning involves the use of an insoluble anode in an electrolytic cell. The aqueous solution forms the electrolyte, and a suitable cathode, usually in the form of a plate or sheet on which the metal is deposited, forms the remaining part of the cell. Under suitable conditions, metal of very high purity can be deposited, and the process is used for winning metal from solutions derived from metal ores, scrap metal and from metal refining processes. In particular, copper, nickel, cobalt, manganese and zinc are common metals which may be extracted from acid solutions by such a process and such solutions are completely or partly stripped of their metal content without significant replenishment from the anode material. Electrowinning is to be distinguished from electrorefining in which the anode is a soluble anode principally composed of the metal which is to be deposited on the cathode.

Ideally, the anode used in electrowinning should be completely resistant to the electrolytic conditions, should suffer no weight loss, should not form a passiive film or give rise to any reaction which would interfere with the cathodic deposition of metal at an economic current density. In practice, these conditions cannot be fulfilled by any economically realistic anode and all of the anodes presently being used have a small amount of dissolution which may affect the purity of the metal deposit. Thus, lead and lead-based alloy anodes, which are widely used in electrowinning, are not completely resistant to anodic loss and some lead becomes codeposited with the copper, thereby reducing the purity and hence the commercial value of the copper deposit. Whilst the wear rate of lead and lead-based alloys may be acceptably low for low current density electrolytic cells, some lead is picked up in the cathode and the wear rate increases in certain commonly found conditions. These are increasing current density, increasing acidity, increasing electrode temperatures and increasing chloride concentration. With the increase in current density, lead tends to oxidise and flake away from the anode and this increases the removal rate to an unacceptable degree. Lead in copper has a deleterious effect on the conductivity of the copper and it also adversely affects the ability to draw the copper to fine wire.

Another form of non-consumable anode is titanium, either commercially pure or alloyed, which is coated with some form of noble metal or noble metal compound. Titanium on its own is unsatisfactory because it rapidly polarises when made anodic. By polarisation is meant the rapid formation of an insulating film, usually an oxide, on the exterior surface of the anode material such that it is unable to pass a current at a voltage which is economically viable in a commercial electrowinning cell. Whilst noble metal coated anodes are technically attractive for electrowinning operations, there is a very small loss of noble metal, which although not significantly affecting the purity of the deposited metal, does adversely affect the economics of the process because of the very high cost of the noble metal wastage and the high capital costs of the elctrode.

In the electrorefining of copper, insoluble anodes have been proposed which consist of alloys of copper and silicon with additions of iron, tin, lead and manganese. These alloys, available commercially under the trade name "Chilex", have been used in Chile and are cast into suitable shapes for use in the electrolytic bath. These alloys have been in use for 40–50 years but tests have shown that they have a passivating tendency, principally due to the continual formation of silicon-rich layer on the surface. The wear rate of these alloys is about 10–25mm/year depending on electrolyte conditions and the current density. The wear is principally due to copper passing into solution, which copper is then eventually deposited on the cathode. This dissolution is not in itself objectionable since it does not contaminate the cathode deposit, but it does mean that the anode has to be replaced periodically. Also, the tendency to passivation with increasing wear means that the anode materials have to be removed from the electrolyte and washed to remove the silicon-rich layer on the surface.

In the electrowinning of cobalt, insoluble anodes of cobalt-silicon have been proposed, these alloys being commercially available under the trade name "Luilu". These "Luilu" alloys are again cast into suitable anode shapes and wear gradually in use. Since they are used in cobalt electrolysis, the cobalt is recovered from the anode and is not lost. Both copper-silicon alloys and cobalt-silicon alloys are relatively brittle and can become damaged during transit and handling which again reduces their effective life and increases their costs..

SUMMARY OF THE INVENTION

By the present invention there is provided a method of electrowinning metal comprising electrolysing an aqueous solution of metal using as an anode an alloy containing one or more high melting point, passive film-forming metals as herein defined and one or more of the elements of atomic numbers 23–29 in the Periodic System of Elements, the amount of elements 23–29 being greater than that at which passivation of the alloy occurs and less than that amount at which dissolution of the alloy occurs at more than half the faradaic dissolution rate.

The dissolution rate need not exceed 20mm/year at a current density of 500 amps/m$^2$ and preferably does not exceed 10mm/year.

The present invention further provides a method of recovering an electrowinning metal from an aqueous solution of the metal which comprises the steps of inserting an anode and a cathode into the aqueous solution, connecting the anode to a positive potential with respect to the cathode, passing an electrical current through the anode and the cathode to electrodeposit the metal onto the cathode and removing the cathodically deposited metal from the solution, characterised in that the anode has as its electrically conducting surface an alloy containing one or more high melting point passive film-forming metals as herein defined and one or more of the elements of atomic numbers 23–29 of the Periodic System of Elements, the amount of elements 23–29 being greater than that at which passivation of the alloy occurs and less than that amount at which dissolution of the alloy occurs at more than half the faradaic dissolution rate.

The anode may be a solid integral item of the alloy; alternatively, the anode may include a basket and a current lead to the basket, which may be of foraminate high melting point passive film-forming metal and which contains the alloy in particulate form. The particulate material may be periodically added to the basket.

The anode material may be a copper-titanium alloy, copper being present in an amount in the range 35–80wt%, preferably 40–60wt%. Alternatively, the alloy may be an iron-titanium alloy, iron being present in the range 80–20% by weight. In a further alternative, the alloy may be a nickel-titanium alloy, nickel being present in an amount in the range 35–80%, preferably 40–60% by weight. In a further alternative, the alloy mmay be a titanium-cobalt alloy, cobalt being present by an amount in the range 30–55% by weight.

In a still further embodiment of the invention, the alloy may be a manganese-titanium alloy, the manganese being present in an amount of 30–85wt%, preferably 40–60wt%.

The alloy may contain one or more additional elements chosen from the group hydrogen, aluminium, tin, oxygen, molybdenum, silicon, palladium, platinum, ruthenium, iridium, phosphorus or carbon, in an amount so as not to excessively adversely affect the dissolution rate of the anode material.

The upper limits of the additional elements may be: hydrogen up to 0.2wt%, aluminium up to 10wt%, tin up to 8wt%, oxygen up to 1.5wt%, molybdenum up to 25wt%, silicon up to 30wt%, palladium up to 0.5wt%, platinum up to 0.5wt%, ruthenium up to 0.5wt%, iridium up to 0.5wt%, phosphorus up to 10wt%, carbon up to 15wt%, the additional elements totalling no more than 40%.

The invention still further provides an electrolytic cell comprising an anode basket and a cathode, both located in an aqueous electrolyte including ions of an electrowinnable metal, the anode being connectable electrically positive with respect to the cathode, and an anode material in the basket, the anode material being a particulate alloy of one or more high melting point passive film-forming metals as herein defined and one or more elements of atomic numbers 23–29 of the Periodic System of Elements, the amount of elements 23–29 being greater than that at which passivation of the alloy occurs and less than the amount at which dissolution of the alloy occurs at more than half the faradaic dissolution rate.

The electrolytic cell may utilise an alloy of titanium with any one of the metals chosen from the group copper, iron, cobalt and nickel. The dissolution rate may be less than 20mm/year, preferably less than 10mm/year, at a current density of 500 amps/m$^2$.

The present invention still further provides an anode material comprising an alloy of one or more high melting point passive film-forming metals as herein defined and one or more of the elements of atomic numbers 23–29 of the Periodic System of Elements, the amount of elements 23–29 being greater than that at which passivation of the alloy occurs and less than that amount at which dissolution of the alloy occurs at more than half the faradaic dissolution rate when used in the method according to the present invention.

The dissolution rate need not exceed 20mm/year, preferably 10mm/year, when used at a current density of 500 amps/m$^2$.

The high melting point passive film-forming metals are titanium, zirconium, niobium and tantalum. Zirconium may contain hafnium which occurs naturally with zirconium. These metals in the unalloyed state form in certain electrolytes a passive film which inhibits transfer of electrons and all are corrosion-resistant.

Elements 23–29 are vanadium, chromium, manganese, iron, cobalt, nickel and copper. By "faradaic dissolution rate" is meant the rate at which material dissolves when all the current through the anode is used in dissolution of the metal.

The alloys used as anode material may contain as impurities derived from the constituents of the alloy several percent of other elements normally associated with such materials.

BRIEF DESCRIPTION OF THE DRAWINGS

By way of example, embodiments of the present invention will now be described with reference to the accompanying drawings, of which.

DESCRIPTION OF THE PREFERRED EMBODIMENTS

Figure 1:
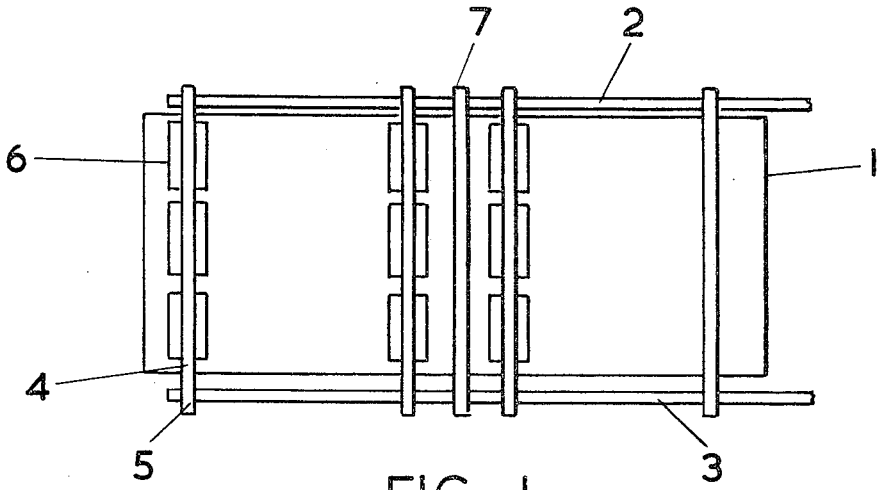
FIG. 1 is a plan view of one embodiment of the invention.

An electrowinning cell basically comprises a tank 1 having copper busbars 2 and 3 running in parallel along either side of the tank. The busbar 2 is connected to a positive source of electricity and the busbar 3 is connected to a negative source. Located in the tank 1 are a series of anodes and cathodes which alternate along the length of the tank. In the embodiment of FIG. 1, the anodes 4 are in the form of hanger bars 5 from which depend foraminate titanium baskets 6. The cathodes 7 are in the form of copper-cored titanium hanger bars to which are welded sheets of titanium to form the surface on which the electrowon material is deposited. The electrical supply to the anodes 4 is via the busbar 2 and the electrical supply to the cathode 7 is via the busbar 3.

Figure 3:
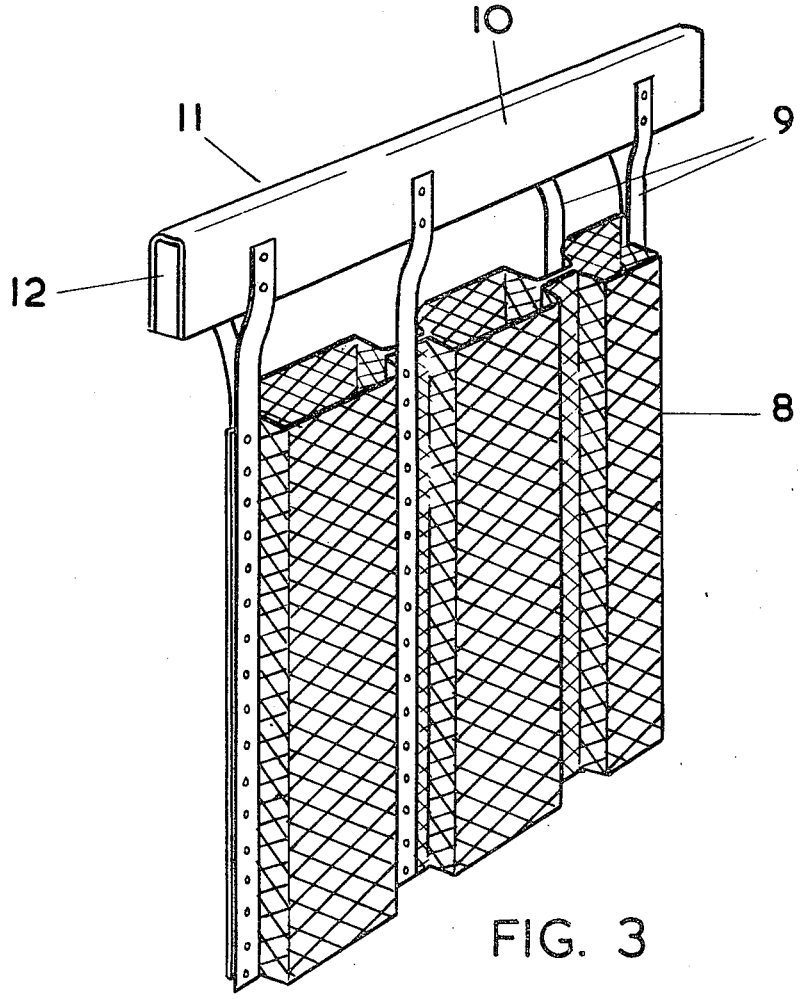
FIG. 3 is a perspective view of a foraminate basket and hanger bar assembly.
Figure 2:
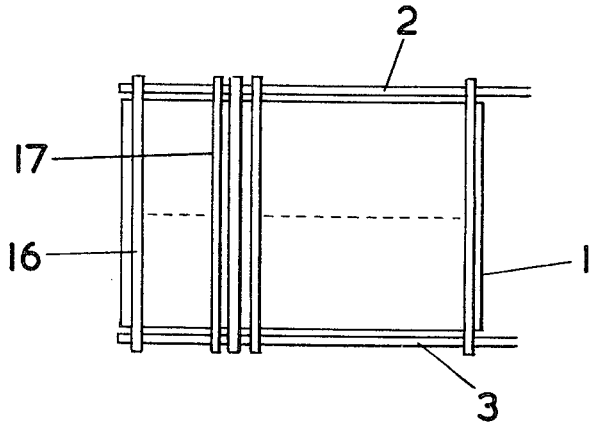
FIG. 2 is a plan view of a second embodiment.
Figure 4:
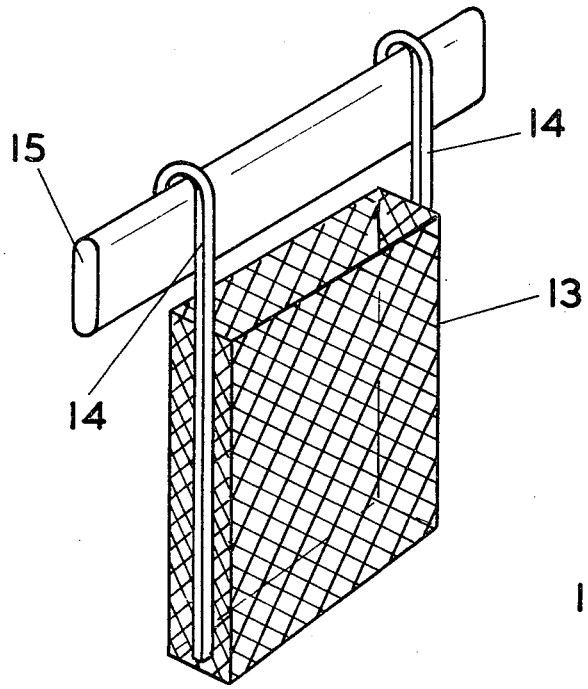
FIG. 4 is a perspective view of a foraminate basket having hooks and a hanger bar assembly.

The form of the anode container is shown clearly in FIG. 3. A multicompartment titanium mesh basket 8 is spot-welded to titanium strips 9 which at their upper ends are spot-welded to a sheath 10 of a copper-cored hanger bar 11. The copper core 12 provides a high conductivity throughout the length of the hanger bar 11 protected by the exterior sheath 10. The exterior sheath also enables good electrical contact to be made between the copper and the basket. Into the compartments of basket 8 is placed the anode material of the invention in a particulate form such as small blocks or small slabs. During operation of the cell, the anode material is gradually consumed and is simply replaced by adding further particles of the anode material into the basket.

In an alternative form, the anode comprises a foraminate titanium basket 13 which is suspended by hooks 14 from a copper hanger bar 15.

Figure 5:
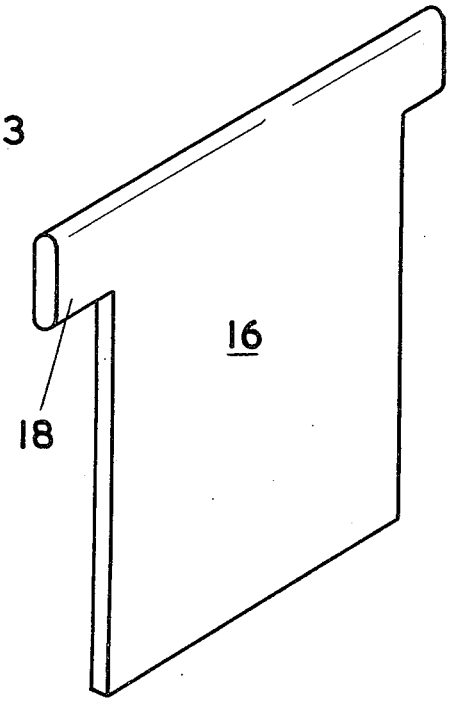
FIG. 5 is a perspective view of a cast anode.

In an alternative form of the invention, the anodes 16, which alternate with the cathodes 17 in the electrolytic cell, are in the form of cast slabs of the material as is shown clearly in FIG. 5. The ears 18 at the upper end of the slab 15 enable the slab to be positioned in and supported in the electrolytic cell. Additionally, current can be led into the anode via the ears 18.

The use of titanium anode baskets has been previously disclosed in connection with electroplating of various articles but has not previously been considered possible for electrowinning applications. Clearly it would be useless to use pure copper in the basket in an electrowinning cell since the anode would simply dissolve completely, leaving only the titanium basket which would rapidly passivate and the electrolysis would stop.

It has been discovered that, using the anode material of the invention in a titanium anode basket, the current is able to pass through the oxide film on the titanium basket, into the anode material and this conductivity is sufficient for an economic electrowinning cell.

The choice of anode material depends to some extent on the metal being deposited. Where, for example, copper is that metal, an alloy of titanium and copper is particularly advantageous since any copper which is slowly dissolved from the anode material will not adversely affect the quality of the copper deposit by altering the purity of the deposit or its form of growth. A number of examples are given below which exemplify various embodiments of the invention.

EXAMPLE 1

Copper-titanium alloys were arc-melted under argon at a pressure of 400mm of mercury. The material was triple melted to reduce the risk of segregation and the material was then made into solid anodes after the surface had been abraded with 800 grit emery. The anodes were tested in sulphuric acid and sulphuric acid-containing copper sulphate. The results of the tests are given in Table I.

TABLE I

Wear Rate of Copper-Titanium Alloys Under Various Conditions

| Alloy | Environment | Current Density Amps/m² | Wear Rate (mm/year) |
|---|---|---|---|
| $Ti_2Cu$ | 150g/l $H_2SO_4$, 20°C | 500 | 11.4, 9.1 |
| TiCu | 150g/l $H_2SO_4$, 20°C | 500 | 11.4, 8.1 |
| $Ti_2Cu_3$ | 150g/l $H_2SO_4$, 20°C | 500 | 19.2, 17.9 |
| $TiCu_3$ | 150g/l $H_2SO_4$, 20°C | 500 | 106.4, 92.2 |
| $Ti_2Cu$ | 150g/l $H_2SO_4$ + 40g/l $Cu^{2+}$, 20°C | 500 | 7.7, 7.9 |
| | 40°C | | 7.6 |
| | 60°C | | 14 |
| Ti 50wt% Cu | 150g/l $H_2SO_4$ + 40g/l $Cu^{2+}$, 20°C | 500 | 10.4 |
| Ti 52.5wt% Cu | 150g/l $H_2SO_4$ + 40g/l $Cu^{2+}$, 20°C | 500 | 9.5 |
| Ti 55wt% Cu | 150g/l $H_2SO_4$ + 40g/l $Cu^{2+}$, 20°C | 500 | 9.3 |
| TiCu | 150g/l $H_2SO_4$ + 40g/l $Cu^{2+}$, 20° C | 500 | 7.5, 8.2 |
| | 40°C | | 11.7 |
| | 60°C | | 31 |
| Ti 60wt% Cu | 150g/l $H_2SO_4$ + 40g/l $Cu^{2+}$, 20°C | 500 | 9.3 |
| TiCu + 0.1% Pt | 150g/l $H_2SO_4$ + 40g/l $Cu^{2+}$, 20°C | 500 | 7.9 |
| TiCu + 0.5% Pt | 150g/l $H_2SO_4$ + 40/g/l $Cu^{2+}$, 20°C | 500 | 7.3 |
| TiCu + 1.0% Pt | 150g/l $H_2SO_4$ + 40g/l $Cu^{2+}$, 20°C | 500 | 7.0 |
| TiCu | 150g/l $H_2SO_4$ + 40g/l $Cu^{2+}$, 20°C | 500 | 9.1 |
| TiCu | 150g/l $H_2SO_4$ + 40g/l $Cu^{2+}$, 20°C | 2000 | 37.6 |
| TiCu | 150g/l $H_2SO_4$ + 40g/l $Cu^{2+}$, 20°C | 5000 | 101.9 |
| TiCu | 100g/1 $H_2SO_4$ + 40g/l $Cu^{2+}$, 20°C | 500 | 7.2 |
| TiCu | 150g/l $H_2SO_4$ + 40g/l $Cu^{2+}$, 20°C | 500 | 7.8 |
| TiCu | 200g/l $H_2SO_4$ + 40g/l $Cu^{2+}$, 20°C | 500 | 8.0 |

It can be seen that there is little change in the wear rate as the composition of the alloy is changed from 40wt% copper to 60wt% copper. The cell voltage increases with decreasing copper content when less than 55wt% copper is present in the alloy. For titanium 50wt% copper at 20°, 150g/l $H_2SO_4$, 40g/l $Cu^{2+}$ at a current density of 300 amps/m², the dissolution rate is approximately 1.9% of the faradaic dissolution rate.

The wear rate of titanium-copper alloys changes almost linearly as the current density is increased from 500 amps/m² to 5000 amps/m². It can be seen, however, that the rate of dissolution of titanium-copper does not depend upon acidity of the ellctrolyte over the range 100–200g/l sulphuric acid. It can be seen that the wear rate increases with increasing temperature in the range 20–60°C for both $Ti_2Cu$ and TiCu. Additions of platinum to the TiCu alloy (where TiCu appears in Table I is meant the intermetallic compound which contains equal atomic proportions of titanium and copper) reduced the rate of dissolution only slightly and the cell voltage was also reduced only slightly.

EXAMPLE 2

Three titanium-manganese alloys were tested under conditions of 150g/l sulphuric acid, 40g/l copper and a current density of 500 amps/m² at ambient temperature.

| | | | | |
|---|---|---|---|---|
| 1. | TiMn | Ti 46.58wt% | Mn 53.42wt% | Corrosion rate 18.6mm/year |
| 2. | $TiMn_2$ | Ti 30.36wt% | Mn 69.64wt% | Corrosion rate 3.7mm/year |
| 3. | $TiMn_3$ | Ti 22.52wt% | Mn 77.48wt% | Corrosion rate 17mm/year |

Test 1 was performed with the material in slab form; tests 2 and 3 utilised material in a basket. The results of tests 2 and 3 are considered less reliable than those of test 1. After 3 days at a current density of 500 amps/m², the $TiMn_3$ became agitated in the basket due to gas evolution and the test was terminated. In all cases the preferred anode reaction was one of oxygen evolution.

EXAMPLE 3

Silicon additions were made to a basic material of $TiCu_3$ under the same electrolysis conditions as for Example 2. Three alloys were tested as follows, under the same electrolysis conditions as Example 2.

| | | Ti wt% | Cu wt% | Si wt% |
|---|---|---|---|---|
| A | 90% $TiCu_3$ + 10% Si | 18.1 | 73.8 | 9.1 |
| B | 80% $TiCu_3$ + 20% Si | 16.6 | 66.7 | 16.7 |
| C | 70% $TiCu_3$ + 30% Si | 15.3 | 61.6 | 22.1 |

The corrosion rates were for A 226.8mm/year, and C 118mm/year. Sample B shattered and no test results were available. In view of the adverse effect of silicon, copper-silicon alloys were tried (ie similar to "Chilex") and these are given below as Example 19.

EXAMPLE 4

Titanium-iron alloys were tested and the same conditions were used as far as electrolyte, current density etc as for Example 2. Three alloys of 25%, 30% and 35% iron were tested and the cell voltage measured over a period of up to 168 hours. The results obtained were as follows:

| Time in hours | 6 | 24 | 48 | 72 | 96 | 126 | 150 | 168 |
|---|---|---|---|---|---|---|---|---|
| Ti + 25% Fe | 3.60 | 3.17 | 3.06 | 3.09 | 2.99 | 2.98 | 2.94 | 2.94 |
| Ti + 30% Fe | 3.18 | 2.89 | 2.83 | 2.82 | 2.77 | 2.78 | 2.75 | 2.74 |
| Ti + 35% Fe | 3.00 | 2.85 | 2.79 | 2.81 | 2.75 | 2.73 | 2.70 | 2.69 |

The corrosion rate for the 25wt% iron was 4.32mm/year which corresponds to 1.0% of the faradaic dissolution rate, for the 30% iron was 7.7mm/year and for the 35% iron was 10.7mm/year. These alloys, particularly the 25wt% iron alloy, were deemed to be particularly useful.

EXAMPLE 5

Titanium-chromium was manufactured having a 50wt% content of chromium and under the same conditions as Example 2 was found to give a corrosion rate of 128.7mm/year. This is equivalent to approximately 30.9% of the faradaic dissolution rate.

EXAMPLE 6

Titanium-vanadium, having a 5% vanadium content, was manufactured but it was discovered that the cell voltage rose rapidly when material was used in the basket.

EXAMPLE 7

Two titanium-cobalt alloys were manufactured, $Ti_2Co$, having a titanium content of 62wt%, and TiCo, having a titanium content of 44wt%. Under the same conditions as Example 2, the corrosion rate was determined to be 4.7mm/year for $Ti_2Co$, which is equivalent to about 1% of the faradaic dissolution rate, and 27.4mm/year for TiCo, which is equivalent to about 5% of the faradaic dissolution rate.

EXAMPLE 8

Titanium-copper alloys of 50–50 wt% titanium and copper were manufactured with 1%, 2% and 5% of phosphorus added. Under the same conditions as Example 2, the wear rate for 1% phosphorus was 10.6mm/year, for 2% phosphorus it was 11.5mm/year and for 5% phosphorus, it was 10.6mm/year.

EXAMPLE 9

A titanium-copper alloy of 50–50wt% had added to it 1wt% niobium (which is itself a passive film-forming metal) and under the same conditions as Example 2, it was determined that the corrosion rate was 5.2mm/year.

EXAMPLE 10

Two ternary titanium-copper-iron alloys were manufactured of:

a. 50% titanium, 25% copper, 25% iron, and
b. 47.5% titanium, 47.5% copper, and 5% iron. The corrosion rate was 10.4mm/year for (a) and 10.4mm/year for (b). Sample
a. was tested under the same conditions as Example 2, alloy (b) was tested in the same electrolyte as Example 2 with the same current density, but the temperature was 40°C.

EXAMPLE 11

A 50–50wt% copper-titanium alloy had 25% molybdenum added and a second sample had 5% chromium added and tests under the same conditions as Example 2, except that the electrolyte temperature was 40°C, showed a wear rate of 30mm/year for the molybdenum-containing alloy and 12.3mm/year for the chromium-containing alloy.

EXAMPLE 12

To assess the effect of a number of additives in the alloy, a base titanium alloy was manufactured incorporating 3% aluminium, 1.3% tin, 1% vanadium, 1% zirconium, 1% molybdenum, 0.25% copper, .05% silicon. Two copper/titanium alloy compositions were tested, the first one corresponding to the (titanium alloy) $_2$Cu and the second to (titanium alloy)Cu. Under the same test conditions as Example 2, the corrosion rate for the first composition was 11.2mm/year and for the second was 6.9mm/year.

EXAMPLE 13

Two nickel-titanium alloys with compositions corresponding to TiNi and $TiNi_3$ were manufactured and tested under the conditions of Example 2. The wear rate for TiNi was found to be 7.8mm/year and for $TiNi_3$ was found to be 105mm/year, which corresponds to a dissolution rate of 19.7% of the faradaic dissolution rate.

EXAMPLE 14

Since copper-titanium alloys show great promise, a particular further example was tried in particulate form in an anode basket in a commercial electrowinning cell. The alloy 49wt% copper, 0.5wt% iron, 50.5wt% titanium was melted, cast and broken into small pieces. The particles were inserted into a basket of the type illustrated in FIG. 3, the basket having an external size of 1m × 1m × 5cm wide. The basket was made of titanium mesh and was inserted into an electrolytic cell containing 40g/l copper, 200g/l sulphuric acid, 5g/l arsenic, 30g/l nickel, 1g/l iron, balance water except for the normal impurities. The electrolyte was maintained at 60°C and a current density of 150 amps/$m^2$ based on the basket surface area was passed through the anode. After 1640 hours, the weight loss of the material in the basket was only 4.5%. This corresponds to 2.3% of the faradaic dissolution rate. In a second sample of material, after 2252 hours the weight loss was only 4.3%. This corresponds to 1.6% of the faradaic dissolution rate. The anode basket was placed in series in the cell with conventional lead anodes and the anode basket passed a fair proportion of the current through the cell and did not shed current into the lead anodes. This test shows that such a copper-titanium alloy produces wear rates sufficiently low to enable the material to be used economically and viably in an anode basket.

EXAMPLE 15

A second copper-titanium alloy was prepared although the alloy was of much lower purity than the alloy prepared and described in Example 14. After melting, the analysis of the alloy was 56.75% copper, less than 1% iron, 0.5% nickel, 1% aluminium, 1% zirconium, balance titanium. Under exactly the same conditions of cell liquor, current density, temperature and particle sizes as set out in Example 14, it was found that after 1400 hours exposure, there was a weight loss of 47.6%. This corresponds approximately to a wear rate of 20mm/year and to 26% of the faradaic dissolution rate.

EXAMPLE 16

A particulate ferro-titanium alloy was prepared and found to have a composition of 30% iron, 1% copper, .5% nickel, .5% chromium, balance titanium. This material was used in the same liquor and under the same conditions in baskets as set out in Example 14 and it was found that with two separate samples, there was no weight loss at all after 2770 hours' use. This test also shows that particulate ferro-titaniums of the correct composition may be used in anode baskets satisfactorily in commercial electrowinning liquors.

EXAMPLE 17

A nickel 56wt% niobium alloy was cast into a single piece and tested as an anode material. The electrolyte used was an aqueous solution containing 16.5g/l copper, 26.4g/l nickel, 8g/l arsenic, 229 g/l sulphuric acid. The elctrolyte was maintained at 60°C and a current density of 200 amps/m$^2$ was used. A cell voltage of 4.9 volts was required to maintain the current and the wear rate was determined to be 94mm/year.

EXAMPLE 18

A copper 50% zirconium alloy was tested in the same electrolyte and under the same conditions of temperature and current density as for Example 17. Again, the material was cast into a solid piece and it was found that a cell voltage of 3 volts was required to maintain the current and the wear rate was determined to be 50.5mm/year.

COMPARISON EXAMPLE 19

In view of the prior use of copper-silicon alloys in slab form, attempts were made to use the alloy in particulate form in a basket. The alloy 70wt% copper, 20wt% silicon, 8wt% iron, 2wt% lead, was cast and broken up into small pieces. The pieces were placed in an anode basket and were tested in a liquor containing 16.5g/l copper, 26.4g/l nickel, 229g/l $H_2SO_4$, 8g/l arsenic. Using a current density of 200 amps/m$^2$ and a temperature of 60°C, it was found that the cell voltage increased from 2.6 volts to 10.2 volts and that the wear rate was approximately 24mm/year. This wear rate has to be compared with approximately 10–15mm/year for large slabs of material. The important feature to note, however, is that the cell voltage increases to an unacceptably high level and it is believed that this is due to the continual formation of a silicon-rich layer on the alloy surface. This layer effectively insulates the particles one from another, and more importantly, from the basket itself and would mean in practice that this material would not be suitable in small baskets, ie 6 inch deep baskets.

One of the important features of the invention is that the anode material can be chosen in most cases so that the metal which dissolves slowly from the anode is the same as the metal being deposited on the cathode. Thus, no contamination of the cathode material occurs. If, for example, copper is being electrowon, then by using a copper-titanium alloy, it has been found that the amount of titanium incorporated in the copper is less than 15 parts per million. This level of titanium is the detectable limit for the technique used; hence it is probable that there is even less titanium than 15ppm present. Of course, any copper which is incorporated in the cathode from the anode is beneficial rather than deleterious. It is believed that the titanium which is dissolved from the anode is hydrolysed to form titanium oxide which forms part of the anode slime and can be extracted with it. The small amount (if any) of titanium present in the cathodically deposited copper would probably be slagged out if the cathode copper were to be melted.

Similarly, if cobalt was being electrowon by the use of titanium-cobalt alloys, then no significant contamination of the cobalt electrodeposit on the cathode would occur.

The alloys of the invention may be used in slab form if they are sufficiently ductile but it is considered that it is preferable to use them in particulate form because of the ease with which the anodes can be maintained and replaced. A further important feature of the invention is that since the surface area of the anode material within the basket can be altered by changing the particle size (smaller particles giving a greater surface area), the current density at the surface of the anode material can be kept to a relatively low level when compared with slab anodes. Since the wear rate of the material divided by the current density increases as the current density increases, this is extremely valuable since it means that the wear rate can be kept low at the anode by using small particles, although the current density at the cathode and hence the effective cell utilisation can be kept high. When compared with prior art anodes, this advantage can be clearly seen since if it is attempted to use high current densities with copper-silicon alloys, then a high wear rate is obtained. If it is attempted to use a high current density with lead anodes, then a high wear rate and the deleterious incorporation of lead in the cathode deposit occurs.

It has also been discovered that the anode materials of the present invention are relatively unaffected by sulphuric acid concentrations and by chloride ion concentrations, which is not so in connection with lead anodes. The combination of features of the anode materials of the present invention enables them to be used in circumstances and conditions where they are economically advantageous over the prior art anodes which have been used for the past 40–50 years and more.

We claim:

1. A method of electrowinning metal comprising electrolysing an aqueous solution of metal using as an anode an alloy containing one or more high melting point passive film-forming metals selected from the group consisting of titanium, zirconium, niobium and tantalum and one or more of the elements of atomic numbers 23–29 in the Periodic System of Elements, the amount of elements 23–29 being greater than that at which passivation of the alloy occurs and less than that amount at which dissolution of the alloy occurs at more than half the faradaic dissolution rate.

2. A method as claimed in claim 1 in which the dissolution rate does not exceed 20mm/year at a current density of 500 amps/m$^2$.

3. A method as claimed in claim 2 in which the dissolution rate does not exceed 10mm/year.

4. A method as claimed in claim 1 in which the anode material is a copper-titanium alloy, copper being present in an amount in the range 35–80wt%.

5. A method as claimed in claim 4 in which the alloy contains in addition one or more of the elements selected from the group consisting of hydrogen up to 2000 parts per million; aluminium up to 5wt%; chromium up to 10%; tin up to 5%; oxygen up to 1.5%; vanadium up to 2%; molybdenum up to 5%; silicon up to 1%; manganese up to 30%; palladium up to 0.5%; platinum up to 0.5%; ruthenium up to 0.5%; iridium up to 0.5%; phosphorus up to 10%; carbon up to 15%, the additional elements totalling no more than 40%.

6. A method as claimed in claim 4 in which the anode material is a copper-titanium alloy, copper being present in an amount in the range 40–60wt%.

7. A method as claimed in claim 1 in which the alloy is a titanium-manganese alloy, manganese being present in an amount of 30–85wt%.

8. A method as claimed in claim 7 in which manganese is present in an amount of 40–60wt%.

9. A method as claimed in claim 1 in which the alloy is a nickel-titanium alloy, nickel being present in an amount in the range 35–80%.

10. A method as claimed in claim 9 in which nickel is present in an amount in the range 40–60% by weight.

11. A method as claimed in claim 1 in which the anode is a solid anode formed of the alloy.

12. A method as claimed in claim 1 in which the alloy is an iron-titanium alloy, iron being present in the range 80–20% by weight.

13. A method as claimed in claim 1 in which the alloy is a titanium-cobalt alloy, cobalt being present by an amount in the range 30–55% by weight.

14. A method of recovering an electrowinnable metal from an aqueous solution of the metal which comprises the steps of inserting an anode and a cathode into the aqueous solution, connecting the anode to a positive potential with respect to the cathode, passing an electrical current through the anode and the cathode to electrodeposit the metal onto the cathode and removing the cathodically deposited metal from the solution, characterised in that the anode has as its electrically conducting surface an alloy containing one or more high melting point passive film-forming metals selected from the group consisting of titanium, zirconium, niobium and tantalum and one or more of the elements of atomic numbers 23–29 of the Periodic System of Elements, the amount of elements 23–29 being greater than that at which passivation of the alloy occurs and less than that amount at which dissolution of the alloy occurs at more than half the faradaic dissolution rate.

15. A method as claimed in claim 14 in which the dissolution rate does not exceed 20mm/year at a current density of 500 amps/m$^2$ at the anode.

16. A method as claimed in claim 15 in which the dissolution rate does not exceed 10mm/year.

17. A method of electrowinning metal comprising electrolysing an aqueous solution of metal using as an anode a basket of foraminate high melting point passive, film-forming metal containing in particulate form an alloy containing one or more high melting point passive film-forming metals selected from the group consisting of titanium, zirconium, niobium and tantalum, and one or more of the elements of Atomic Numbers 23–29 in the Periodic System of Elements, the amount of Elements 23–29 being greater than that at which passivation of the alloy occurs and less than that amount at which dissolution of the alloy occurs at more than half the faradaic dissolution rate.

18. A method as claimed in claim 17 in which the particulate material is periodically added to the basket.

* * * * *

Notice of Adverse Decision in Interference

In Interference No. 99,798, involving Patent No. 3,957,600, A. G. Ives, J. R. B. Gilbert, J. S. Jacobi, I. R. Scholes and D. J. Astley, METHOD OF AND ANODES FOR USE IN ELECTROWINNING METALS, final judgment adverse to the patentees was rendered Aug. 13, 1980, as to claims 1, 7, 9, 11–14.

[*Official Gazette February 24, 1981.*]